US010696435B2

(12) United States Patent
Schmidt

(10) Patent No.: US 10,696,435 B2
(45) Date of Patent: Jun. 30, 2020

(54) PACKAGING MACHINE AND CUTTER CASSETTE FOR PACKAGING MACHINE

(71) Applicant: GEA Food Solutions Germany GmbH, Biedenkopf-Wallau (DE)

(72) Inventor: Gerd Peter Schmidt, Breidenbach (DE)

(73) Assignee: GEA FOOD SOLUTIONS GERMANY GMBH, Biedenkopf-Wallau (DE)

( * ) Notice: Subject to any disclaimer, the term of this patent is extended or adjusted under 35 U.S.C. 154(b) by 192 days.

(21) Appl. No.: 15/738,785

(22) PCT Filed: Jul. 7, 2016

(86) PCT No.: PCT/EP2016/066148

§ 371 (c)(1),
(2) Date: Dec. 21, 2017

(87) PCT Pub. No.: WO2017/009178

PCT Pub. Date: Jan. 19, 2017

(65) Prior Publication Data

US 2018/0186024 A1 Jul. 5, 2018

(30) Foreign Application Priority Data

Jul. 10, 2015 (DE) ..... 10 2015 212 978

(51) Int. Cl.
*B65B 9/04* (2006.01)
*B26D 1/15* (2006.01)
(Continued)

(52) U.S. Cl.
CPC ..... *B65B 9/04* (2013.01); *B26D 1/151* (2013.01); *B26D 5/02* (2013.01); *B26D 7/22* (2013.01);
(Continued)

(58) Field of Classification Search
CPC .. B65B 9/02; B65B 9/04; B65B 61/08; B65B 2220/06; B23D 35/008; B26D 1/151;
(Continued)

(56) References Cited

U.S. PATENT DOCUMENTS 2,307,452 A * 1/1943 Cohen ..... B26D 7/2621 83/481
3,343,336 A * 9/1967 Bradford ..... B65B 9/04 53/329.4
(Continued)

FOREIGN PATENT DOCUMENTS

DE 4205798 A1 9/1992
DE 10209090 A1 9/2003
(Continued)

OTHER PUBLICATIONS

International Search Report for International Application No. PCT/EP2016/066148; dated Sep. 27, 2016.
(Continued)

*Primary Examiner* — Stephen F. Gerrity
(74) *Attorney, Agent, or Firm* — The Dobrusin Law Firm, P.C.

(57) ABSTRACT

A cutter cassette for a packaging machine, the cutter cassette includes a blade shaft on which at least one longitudinal cutting blade is arranged. The blade shaft can be transferred in a reversible manner from a transporting position into an operating position by lowering the blade shaft relative to a housing. The lowering of the blade shaft takes place under gravitational force.

19 Claims, 7 Drawing Sheets

(51) Int. Cl.

| | |
|---|---|
| ***B26D 5/02*** | (2006.01) |
| ***B26D 7/22*** | (2006.01) |
| ***B65B 61/08*** | (2006.01) |
| ***B26D 7/26*** | (2006.01) |

(52) U.S. Cl.
CPC ..... *B26D 7/2621* (2013.01); *B26D 7/2635* (2013.01); *B65B 61/08* (2013.01); *Y10T 83/7747* (2015.04)

(58) Field of Classification Search
CPC ..... B26D 5/02; B26D 7/22; B26D 7/2621; B26D 7/2635; Y10T 83/7747
USPC ..... 53/559; 83/481, 945
See application file for complete search history.

(56) References Cited

U.S. PATENT DOCUMENTS 3,387,524 A * 6/1968 Huck ..... B26D 7/2635 83/482
3,397,508 A * 8/1968 Stroop ..... B65B 9/04 53/559
3,759,122 A * 9/1973 Lane et al. ..... B65B 61/08 83/24
3,762,251 A * 10/1973 Madsen et al. ..... B65B 61/08 83/39
4,750,318 A * 6/1988 Matsuzawa ..... B65B 61/06 53/559
4,819,406 A * 4/1989 Redmond ..... B65B 9/042 53/559
5,000,069 A * 3/1991 Knobel ..... B26D 5/02 83/285
5,058,472 A * 10/1991 Kakko-Chiloff ..... B23D 35/008 83/344
5,690,012 A 11/1997 Blandin et al.
2001/0047704 A1 12/2001 Adami
2003/0036468 A1* 2/2003 Blank et al. ..... B23D 35/008 493/8
2008/0066427 A1* 3/2008 Meyer ..... B65B 61/08 53/389.1

FOREIGN PATENT DOCUMENTS

DE 202012100166 U1 * 4/2013 ..... B26D 7/22
GB 770948 A * 3/1957 ..... B26D 7/2621
WO WO-2015093245 A1 * 6/2015 ..... B26D 7/2635

OTHER PUBLICATIONS

International Preliminary Report on Patentability for International Application No. PCT/EP2016/066148; dated Jun. 9, 2017.

* cited by examiner

PACKAGING MACHINE AND CUTTER CASSETTE FOR PACKAGING MACHINE

FIELD

The present invention relates to a cutter cassette for a packaging machine, and more specifically to a longitudinal cutter cassette having a blade shaft, on which at least one longitudinal cutting blade is arranged, wherein the blade shaft can be transferred in a reversible manner from a transporting position into an operating position by virtue of being lowered relative to a housing of the longitudinal cutter cassette. The present invention also relates to a packaging machine having the longitudinal cutter cassette according to the invention.

BACKGROUND

Longitudinal cutter cassettes are known from the prior art, for example from DE 42 05 798 A1. However, the longitudinal cutter cassette described in said document has the disadvantage that the longitudinal cutting blades are often damaged when the longitudinal cutter cassette is being installed on a packaging machine, and/or that it is not safe for an operator to transport and/or install or remove.

It was therefore the object of the present invention to provide a longitudinal cutter cassette which does not have the disadvantages of the prior art.

BRIEF SUMMARY

The object is achieved by a longitudinal cutter cassette having a blade shaft, on which at least one longitudinal cutting blade is arranged, wherein the blade shaft can be transferred in a reversible manner from a transporting position into an operating position by virtue of being lowered relative to a housing of the longitudinal cutter cassette, wherein the operation of lowering the blade shaft takes place at least essentially under gravitational force.

The present invention relates to the longitudinal cutter cassette of a packaging machine, by means of which the completed packs of a particular format are singulated. For this purpose, the longitudinal cutter cassette has a rotating blade shaft, on which at least one, usually more than one, longitudinal cutting blade is provided, the blade or blades cutting apart the sheet webs in the longitudinal direction, i.e. parallel to the transporting direction of the sheet webs. Since the blades become blunt through use, the blade shafts have to be changed over at regular intervals. For this purpose, it is usually the case that the entire longitudinal cutter cassette has to be removed. For installation, and removal, the blade shaft, then, can be transferred from a transporting position into an operating position, and vice versa, by virtue of the blade shaft being respectively lowered and raised relative to the housing of the longitudinal cutter cassette. According to the invention, the operation of lowering the blade shaft, i.e. the transfer of the blade shaft from the transporting position into the operating position, takes place at least essentially, preferably entirely, under gravitational force. This ensures that, should a longitudinal cutting blade strike against an obstruction, for example as a result of the longitudinal cutter cassette not being fitted correctly on the packaging machine, the blades are not damaged to any significant extent. If the blade shaft, rather than lowering under gravitational force, remains in a raised position, then it is clear to the operator that the longitudinal cutter cassette is not arranged correctly on the packaging machine, or that there is some other problem and installation has to begin anew. The blade shaft cannot be forced into its operating position by any other means. If, in addition to gravitational force, there is also a drive provided, then this drive has a comparatively low-level overload cut-out, and therefore the force by which the blade shaft can be pushed downward, in addition to the effect of gravitational force, is so limited that there is no chance of the longitudinal cutting blades being damaged.

According to a further, or a preferred, subject matter of the present invention, the longitudinal cutter cassette has a protective enclosure, which is preferably of U-shaped or V-shaped configuration and, together with the base and two side parts, covers the blade shaft such that an operator cannot accidentally injure himself on the blades. The protective enclosure is preferably made from a transparent material, for example Perspex. The protective enclosure remains part of the longitudinal cutter cassette preferably even when the latter is being transported.

According to a further preferred embodiment, the longitudinal cutter cassette has a protective cover, which protects the longitudinal cutter cassette against mechanical influences during operation of the machine and, alongside the protective enclosure, constitutes an additional safeguard for the operator. It is preferably the case that the protective cover is fitted only once the longitudinal cutter cassette has already been installed on the packaging machine. The longitudinal cutter cassette preferably has a bracing and/or safety mechanism, which prevents the protective cover from being placed in position on the longitudinal cutter when the blade shaft is not connected properly to its drive. This prevents malfunctioning of the longitudinal cutter cassette. The protective cover preferably has provided on it an electronic means for imparting the correct position of the protective cover to the packaging machine, and therefore the latter can be brought into operation only when the protective cover is installed correctly on the longitudinal cutter.

According to a further embodiment according to the present invention, or a preferred embodiment of the present invention, the longitudinal cutter has a carrying handle, by means of which the operator can transport the longitudinal cutter cassette, but can also install it on the packaging machine or remove it therefrom. It is preferably the case that a lifting/lowering mechanism of the blade shaft in the longitudinal cutter cassette is driven by a movement of the carrying handle. For example, rotation of the carrying handle in and counter to the clockwise direction respectively raises and lowers the blade shaft, i.e. shifts the latter from its operating position into its transporting position, and vice versa.

According to a further preferred embodiment, the longitudinal cutting cassette has a rigid housing. Rigid, within the context of the invention, means that the parts of the housing cannot be displaced relative to one another. For example, the housing does not have a base which can be displaced in relation to the side walls. This ensures that, even when the longitudinal cutter cassette is set down hard, the blades are not damaged. It is preferably the case that, in its transporting position, the blade shaft is secured against rotation and/or against being lowered and/or being raised up, for example by virtue of the carrying handle being arrested by way of a spring-loaded pin and also by the protective enclosure. This does away with a further risk of injury to the operator.

The present invention also relates to a packaging machine for producing a pack, having a sealing station, which seals a sheet web to a pack cavity or seals together two sheet ends, wherein the pack cavity possibly has been thermoformed into a sheet web or a sheet web has been subjected to a forming process, wherein the packaging machine has at least one circulating chain, which transports preferably a sheet web and has a chain-cleaning, chain-drying and/or chain-lubricating means, wherein the packaging machine has a longitudinal cutter cassette as claimed in one of the preceding claims.

Such a packaging machine is, in particular, a thermoformer or a tray former. In the case of the thermoformer, for example a lower-sheet web is unrolled from a supply roll and transported preferably intermittently along the packaging machine. In a forming station, first of all a pack cavity is formed into the lower-sheet web, and then said cavity is filled with an article, in particular a food item. Thereafter, the pack cavity is sealed, in a sealing station, by one or more upper sheets, which are sealed onto the lower sheet. The upper-sheet web here is likewise unrolled from a supply roll. The sheet web(s) is(are) transported here by endless chains arranged to the right and left to the respective sheet web. Both at the start and at the end of the packaging machine, in each case at least one gearwheel is provided for each chain, the respective chain being deflected around said gearwheel. At least one of these gearwheels, or of gearwheels arranged at some other location, is driven. The gearwheels in the entry region and/or in the exit region can be connected to one another, preferably by a rigid shaft. Each chain has a multiplicity of clamping means, which grip the lower-sheet web with clamping action, along the so-called peripheral strip, in the entry region and transmit the movement of the transporting means to the lower-sheet web. In the exit region of the packaging machine, the clamping connection between the transporting means and the respective sheet web is released again. A transverse cutter is provided downstream of the sealing station, said transverse cutter cutting apart the individual rows of a particular format of packs in a direction transverse to the transporting direction of the sheet webs. Thereafter, the blades of a longitudinal cutter divide up these rows into respectively singulated packs.

According to the invention, the longitudinal cutter is designed in the form of the longitudinal cutter cassette according to the invention.

The packaging machine is preferably provided with a centering means, that interacts with the centering means on the longitudinal cutter cassette and fixes the longitudinal cutter cassette in a clearly predetermined position. The centering means preferably acts or act in two directions in space, in particular two directions located perpendicularly to one another. The centering means are preferably in the form of a rod or a tube oriented transversely to the transporting direction of the sheet. It is also possible for vertical centering means to be provided on the packaging machine. According to a particularly preferred embodiment of the invention, the longitudinal cutter cassette is also fixed on the centering means, and therefore all the forces which occur in the longitudinal cutter cassette are directed into the frame of the packaging machine.

The packaging machine preferably has a manual drive, which interacts with the blade shaft and can rotate the latter into a quite specific removal position. In addition to the manual drive, there is also a motor drive provided, the blade shaft being driven thereby during operation.

The inventions will be explained hereinbelow with reference to the figures. These explanations are merely by way of example and do not limit the general concept of the invention. The explanations apply in equal measure to all the subjects of the present invention.

DETAILED DESCRIPTION

Figure 1:
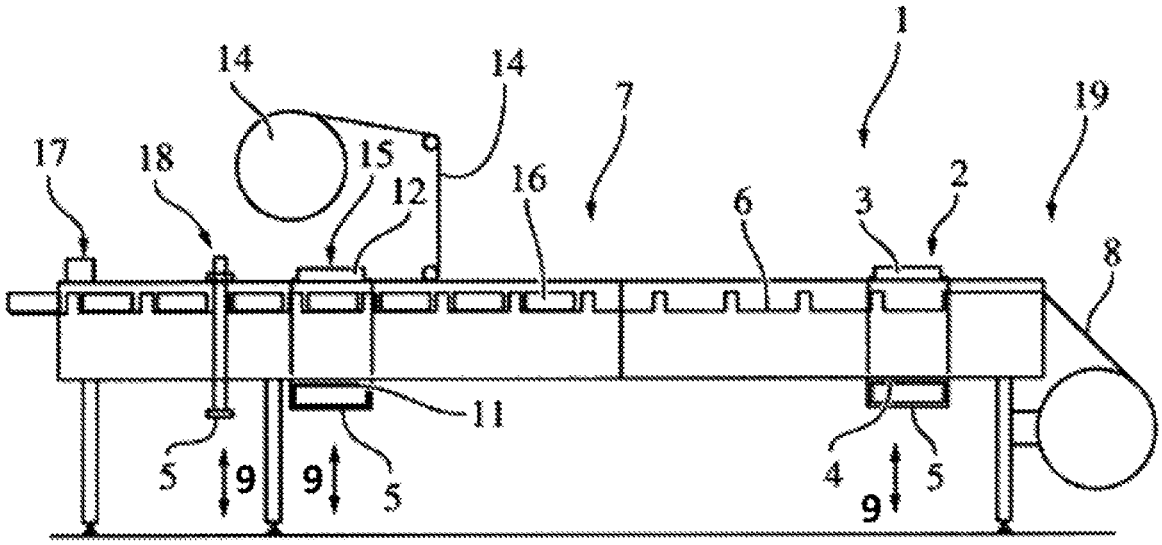
FIG. 1 shows the packaging machine according to the invention.

FIG. 1 shows the packaging machine 1 according to the invention, in the present case a so-called thermoformer, which has a thermoforming station 2, a filling station 7 and a sealing station 15. A lower-sheet web 8, in this case a plastic-sheet web 8, is withdrawn from a supply roll and transported from right to left at regular intervals along the packaging machine according to the invention. The sheet roll is usually mounted on a shaft. In one interval, the lower-sheet web 8 is transported onward by a single advancement step, a plurality of advancement steps being required in order to produce a finished pack. For this purpose, the packaging machine has two transporting means (not illustrated), in the present case in each case two endless chains, which are arranged to the right and left of the lower-sheet web 8. Both at the start and at the end of the packaging machine, in each case at least one gearwheel is provided for each chain, the respective chain being deflected around said gearwheel. At least one of these gearwheels is driven. The gearwheels in the entry region and/or in the exit region can be connected to one another, preferably by a rigid shaft. Each transporting means has a multiplicity of clamping means, which grip the lower-sheet web 8 with clamping action in the entry region 19 and transmit the movement of the transporting means to the lower-sheet web 8. In the exit region of the packaging machine, the clamping connection between the transporting means and the lower-sheet web 8 is released again. A heating means for heating the sheet web 8, in particular when the latter is at a standstill, is provided downstream of the entry region 19. In the thermoforming station 2, which in this case has an upper tool 3 and a lower tool 4, the latter having the mold of the pack cavity which is to be produced, the pack cavities 6 are formed into the heated-up film web 8. It is usually the case that a particular format of pack cavities comprising a plurality of rows and/or a plurality of columns each with a plurality of pack cavities is produced in one operation during one interval. The lower tool 4 is arranged on a lifting table 5, which, as is symbolized by the double arrow, can be adjusted vertically, the adjustment movement taking place by way of a lifting apparatus. Prior to the sheet being advanced in each case, the lower tool 4 is lowered and then raised again. Further along the packaging machine, the pack cavities are then filled with the article 16 in the filling station 7. In the following sealing station 15, which likewise comprises an upper tool 12 and a vertically adjustable lower tool 11, an upper sheet 14 is fastened with material bonding, for example by sealing, on the lower-sheet web 8. It is also the case in the sealing station that the upper tool and/or the lower tool are/is lowered and/or raised before and after the sheet is transported in each case. It is also the case that the upper sheet 14 is unrolled from a sheet roll, mounted on a shaft, and can be guided in transporting means or transported by transporting chains, said transporting means then extending only from the sealing station and possibly downstream. Otherwise, what has been said in relation to the transporting means of the lower sheet applies. It is also the case that the upper sheet can be heated up by a heating means and thermoformed. For sealing purposes, the lower tool 11 provided is, for example, a heatable sealing frame which, for each pack cavity, has an opening into which the pack cavity penetrates during sealing, i.e. during the upward movement of the lower sealing tool. For sealing purposes, the upper-sheet and the lower-sheet webs are pressed together between the upper tool 12 and the lower tool 11 and bond under the influence of heat and pressure. Following sealing, the tools 11, 12 are moved apart vertically again. A dancer mechanism is can preferably be provided between the respective supply roll and the sealing tool, said dancer mechanism compensating for the intermittent advancement of the lower sheet 8 and thus for the intermittent withdrawal of the upper-sheet web 14. The dancer mechanism can serve as a sheet-web store and/or to generate a certain amount of sheet tensioning. A person skilled in the art will understand that a plurality of upper sheets may be present, for example in the case of a multilayered pack or of a pack with a plurality of upper sheets. It is preferably then the case that a dancer mechanism is provided over the course of each upper sheet. A person skilled in the art will also understand that a dancer mechanism may also be provided in the region of the lower sheet 8, preferably downstream of the supply roll of the same. Further along the packaging machine, the completed packs are singulated, this taking place in the present case by way of the transverse cutter 18 and the longitudinal cutter 17. In the present case, the transverse cutter 18 can likewise be raised and lowered by a lifting device 9. According to the invention, the longitudinal cutter 17 has a longitudinal cutter cassette 10, in which is provided a rotating blade shaft, which has at least one, usually more than one, longitudinal blade. The longitudinal cutter cassette is installed on the packaging machine above the sheet-transporting plane. It is usually the case that the longitudinal blades interact with counter-blades or nip rollers, which are located beneath the sheet-transporting plane.

Figure 2:
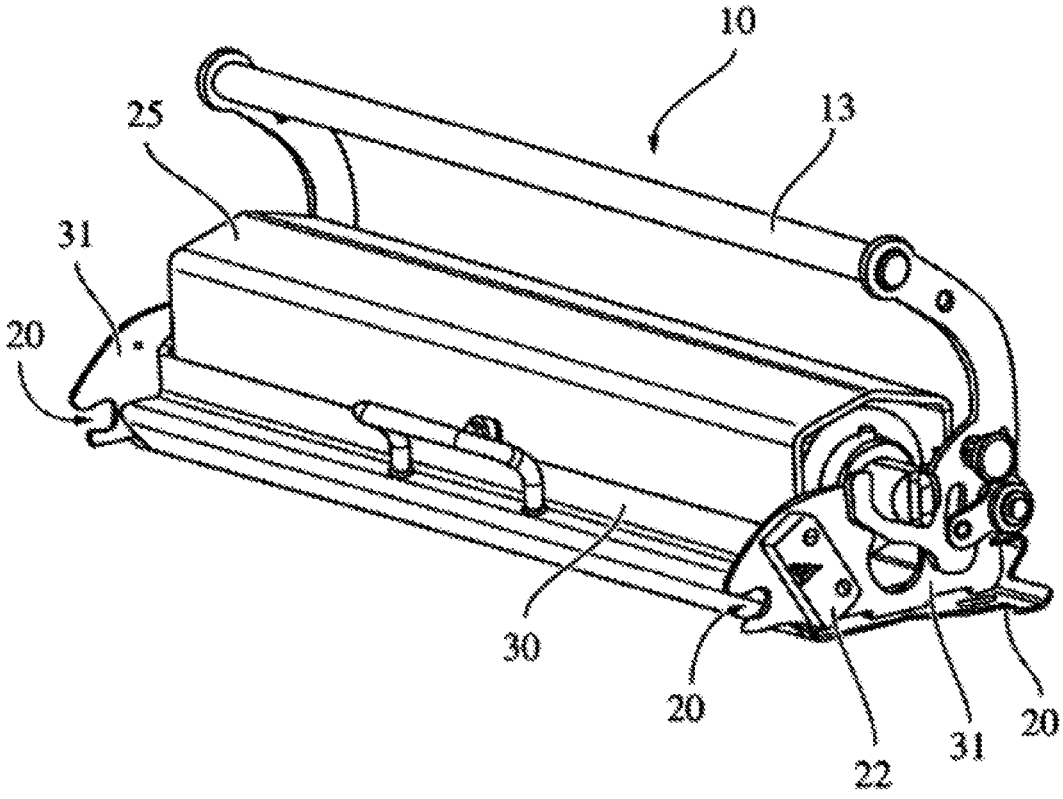
FIG. 2 shows the longitudinal cutter cassette.
Figure 3:
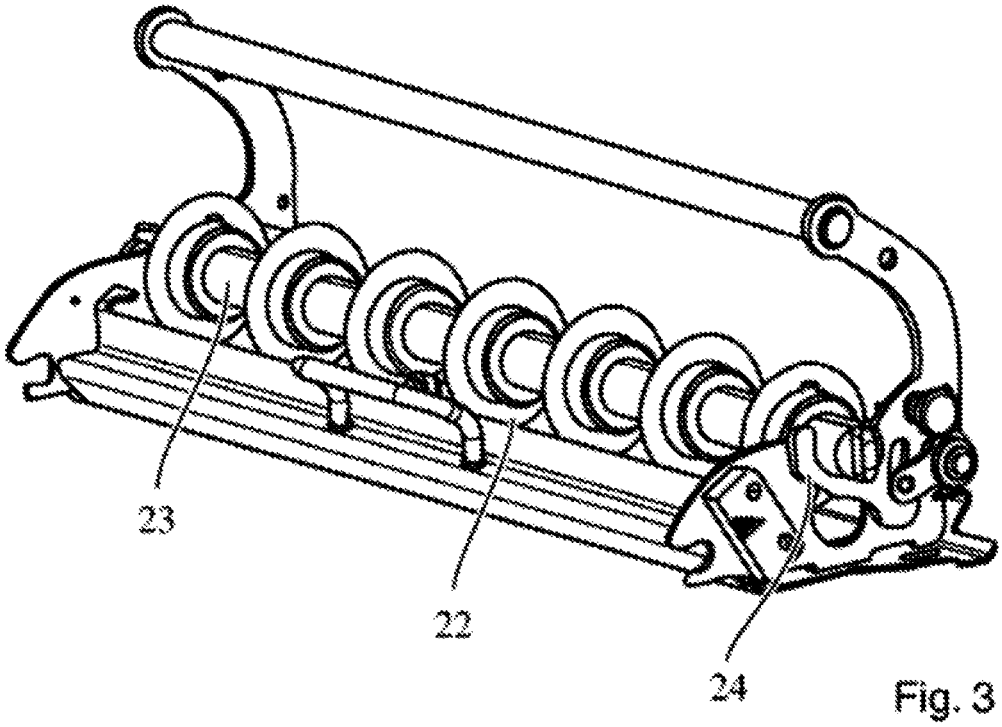
FIG. 3 shows the longitudinal cutter cassette.

FIGS. 2 and 3 show the longitudinal cutter cassette 10 according to the invention. This has a baseplate 30, and in the present case two side parts 31 and preferably a protective enclosure 25, which is preferably of essentially U-shaped or V-shaped configuration. As can be gathered in particular from FIG. 3, a blade shaft 23, on which a plurality of longitudinal cutting blades 22 are provided, is located in the longitudinal cutter cassette 10. During operation, the blade shaft is driven in rotation. In the raised, transporting position illustrated here, the blade shaft has been mounted on the side parts 31 and is retained in the raised position by a lifting and lowering mechanism 24. In addition, the longitudinal cutter cassette has a handle 31, by means of which the longitudinal cutter cassette can be held and carried, but also installed and removed. For proper, positionally precise installation, the longitudinal cutter cassette has in the present case four centering means 20, which fix the longitudinal cutter cassette in at least two directions in space, which are located preferably perpendicularly to one another. The front centering means are circle-segment-form recesses which interact with a rod on the packaging machine, said rod running transversely to the transporting direction, and define the position of the longitudinal cutter cassette parallel to the transporting direction of the sheet web. The position of the longitudinal cutter cassette in a direction transverse to the transporting direction of the sheet is defined by the centering means 20 located behind, which are secured for example by a mushroom-head structure which projects vertically and from the sheet planes and also secures the longitudinal cutter cassette against being raised up. In addition, the longitudinal cutter cassette preferably has an identifier 22, which interacts with an identifier, for example, of a further protective cover 41 (see FIGS. 11-12*a*, 12*b*). It is only when this identifier detects the counterpart on the protective cover that the packaging machine can be brought into operation.

Figure 4:
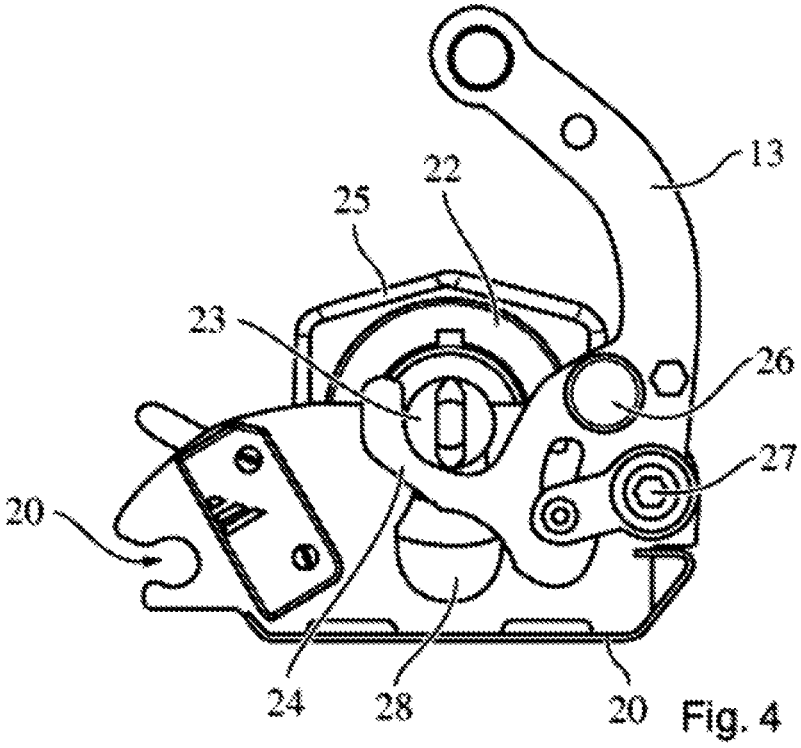
FIG. 4 shows the blade shaft in its raised, transporting position.
Figure 5:
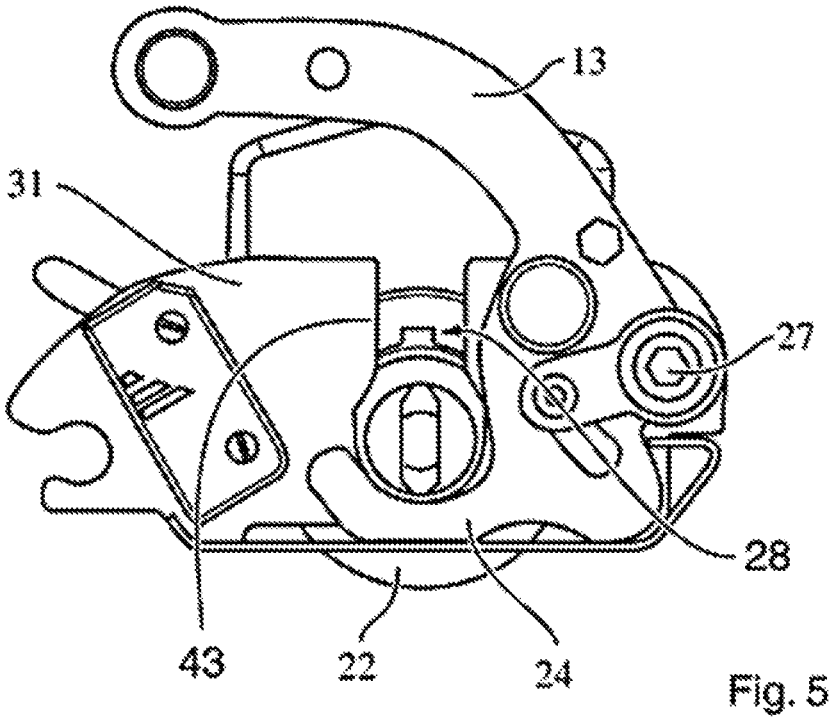
FIG. 5 shows the blade shaft in its lowered, operating position.

FIGS. 4 and 5 show the blade shaft in its raised (FIG. 4), transporting position and in its lowered (FIG. 5), operating position. It can be seen that in the present case the lifting and lowering mechanism is driven by the lever 13. In the present case, the lifting and lowering mechanism 24 is even provided in one piece with the lever. In the raised position, the blade shaft 23 rests on the mechanism 24, and the latter prevents the blade shaft from being able to be lowered under gravitational force. The blade shaft is guided laterally in the side parts 31, wherein, as can be gathered in particular from FIG. 5, these side parts, in the upper region, have vertical guides 43 to secure the shaft against rotation. Consequently, the shaft cannot rotate in its transporting position, and this constitutes an additional safety feature for the operator. In their transporting position, the blades 22 do not project out of the baseplate of the cassette. In the case of the cassette according to the invention, the baseplate 30 is preferably fixed to the side parts and not, as is often customary in the prior art, provided in a displaceable manner in relation to the side parts. This ensures that, even as a result of the longitudinal cutter cassette 10 being set down hard on an underlying surface, the cutting blades are not damaged. If, then, the blade shaft 23 is to be transferred from its transporting position into its operating position, the lever 13 is rotated about the point of rotation 27 in this case in the counter-clockwise direction. For this purpose, a safety catch 26 has to be actuated preferably beforehand, to avoid this movement taking place accidentally. As soon as the lever is rotated, the blade shaft, as long as there is no obstruction present, lowers from its transporting position into its operating position, which is illustrated in FIG. 5 and in which the blades project out of the baseplate for example through slots. Accordingly, the operation of lowering the blade shaft 23 takes place exclusively under gravitational force. For the case where the blade shaft does not lower, the operator on site knows that the movement is being obstructed and therefore has to ensure that the obstruction is removed before the blade can be transferred from the transporting position into the operating position.

Figure 6A:
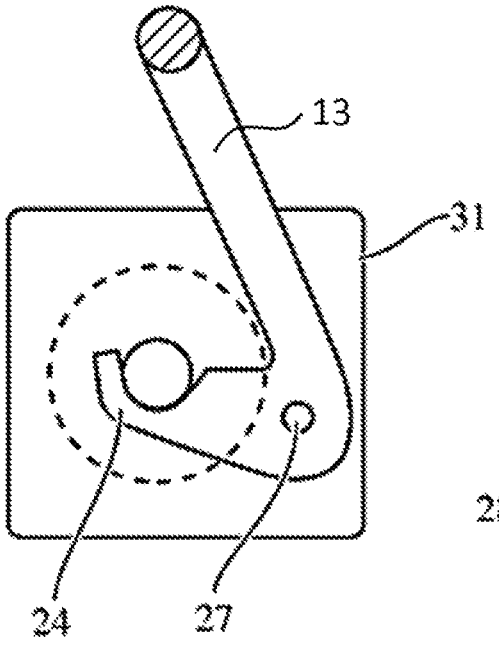
FIGS. 6*a*, 6*b* show the lifting and lowering mechanism of the blade shaft.
Figure 6B:
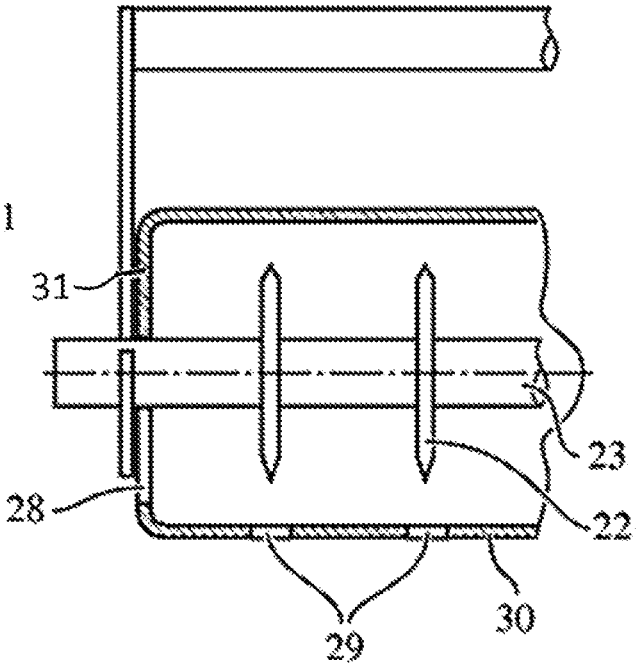
Figure 7A:
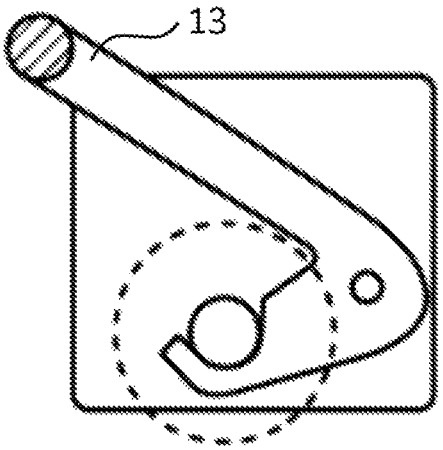
FIGS. 7*a*, 7*b* show the connection between the blade shaft and a drive.
Figure 7B:
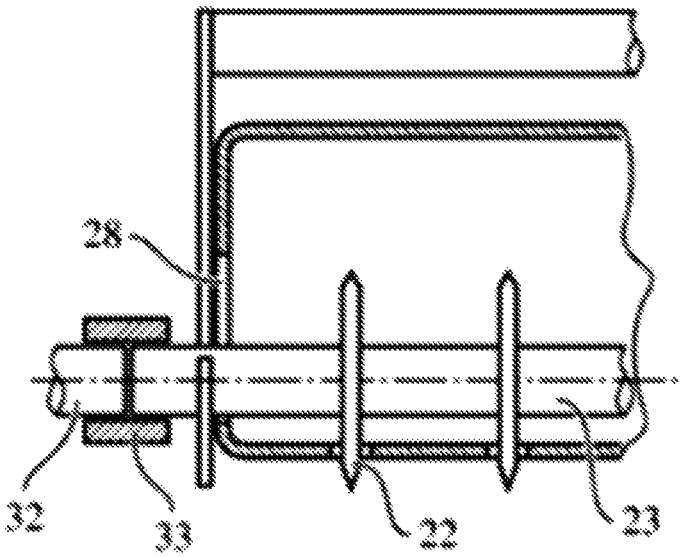

FIGS. 6*a*, 6*b*, 7*a*, and 7*b* show, once again, details relating to the operation of lowering the blade shaft 23 from the transporting position, which is illustrated in FIGS. 6*a* and 6*b*, in the operating position, which is illustrated in FIGS. 7*a* and 7*b*. It can clearly be seen that the blade shaft is guided in a slot 28 in the side wall 31 and that the baseplate has apertures, in this case slots 29. It can also be seen that a rotary movement of the lever 13 frees the way for the blade shaft 23 to be lowered under gravitational force. In the operating position, which is illustrated in FIGS. 7*a* and 7*b*, the cutting blades project out through the baseplate and can thus cut the sheet webs 8, 14. It is also possible, in this position, for the blade shaft to be connected to a driveshaft 32 such that a torque is transmitted from the driveshaft to the blade shaft. The interface between the driveshaft 32 and the blade shaft 23 is secured preferably by bushing 33, which is mounted preferably in a longitudinally displaceable manner on the side wall 31.

Figure 8:
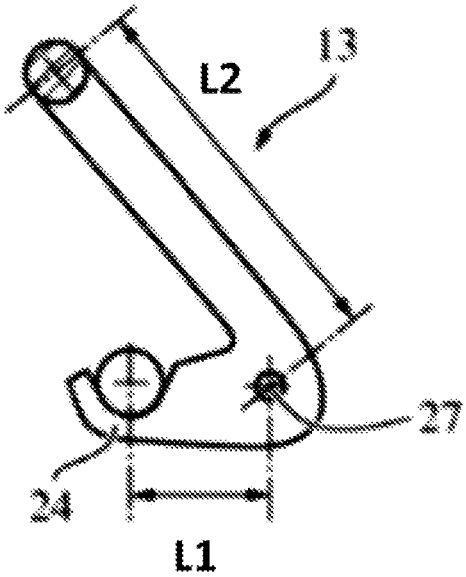
FIG. 8 shows the handle.

FIG. 8 shows details relating to the handle 13, for example the lifting and lowering mechanism 24 connected in one piece thereto. Selecting the length of the lever L2 between the point of rotation 27 and the gripping location of the handle 13 and the length of the lever L1 between the bearing location of the blade shaft 23 and the point of rotation 27 makes it possible to ensure, on the one hand, that the blade shaft can move reliably from the operating position into the transporting position, and vice versa. It is also possible to ensure, on the other hand, that the gripping location of the handle 13 is located at a convenient height for carrying the longitudinal cutter cassette.

Figure 9A:
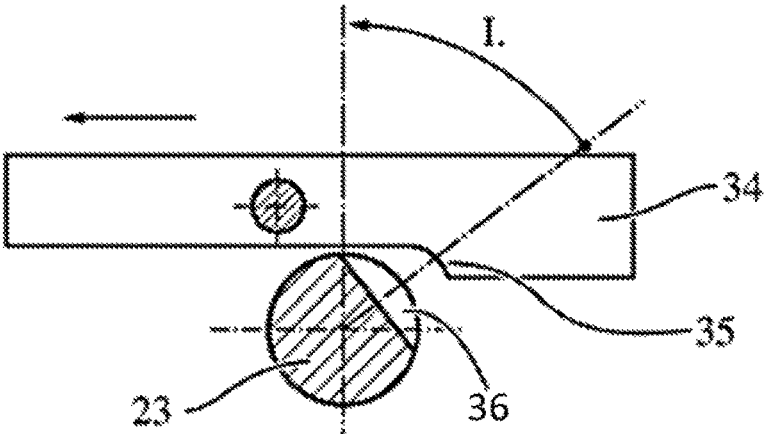
FIGS. 9*a*, 9*b* show the locking system of the longitudinal cutter cassette.
Figure 9B:
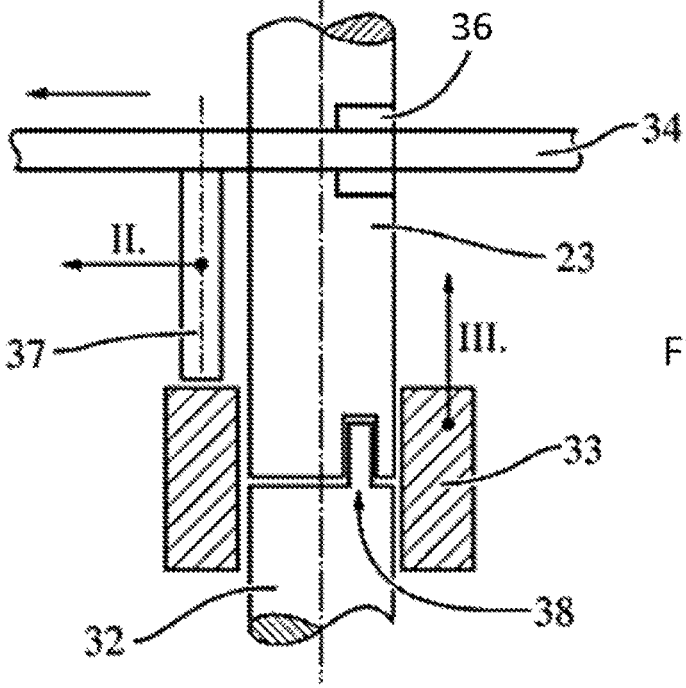

FIGS. 9*a* and 9*b* show parts of the locking system of the longitudinal cutter cassette. For removal of the longitudinal cutter cassette, the locking bar 34 has to be transferred from an operating position into an unlocking position, which in the present case takes place by way of a linear movement from right to left. In the region where the locking bar 34 is provided, the blade shaft 23 has a flattened portion 36 which, when the locking bar moves from right to left, interacts with the flattened portion 36 and thus rotates the blade shaft into an unlocking position. As can be seen in the lower part of FIG. 9, the movement of the locking bar 34 from right to left also results in the movement from right to left of a locking pin 37, which thus disengages from a bushing 33, which thus frees the transition between the blade shaft 23 and the driveshaft 32, this being symbolized by the movement III, as a result of which the blade shaft can be removed.

Figure 10:
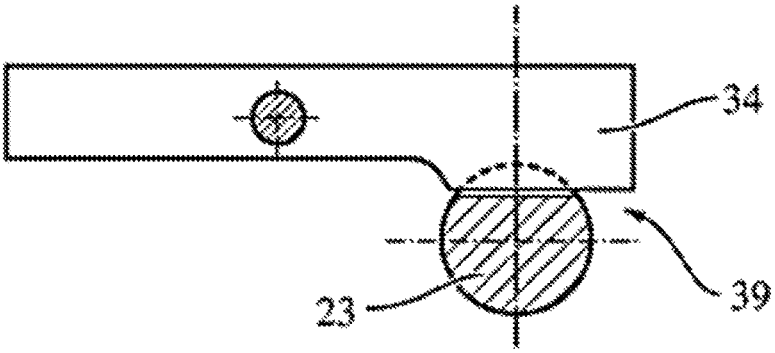
FIG. 10 shows the locking system of the longitudinal cutter cassette.

FIG. 10 shows, once again, the interaction between the locking bar 34 and the blade shaft 23, which is retained in a quite specific angle-of-rotation position by the locking bar 34. Coming back to FIG. 9, it is also possible to see, in the lower part of the figure, the form-fitting and/or force-fitting connection between the driveshaft 32 and the blade shaft 23, said connection being configured in the present case in the form of a groove/error connection.

Figure 11:
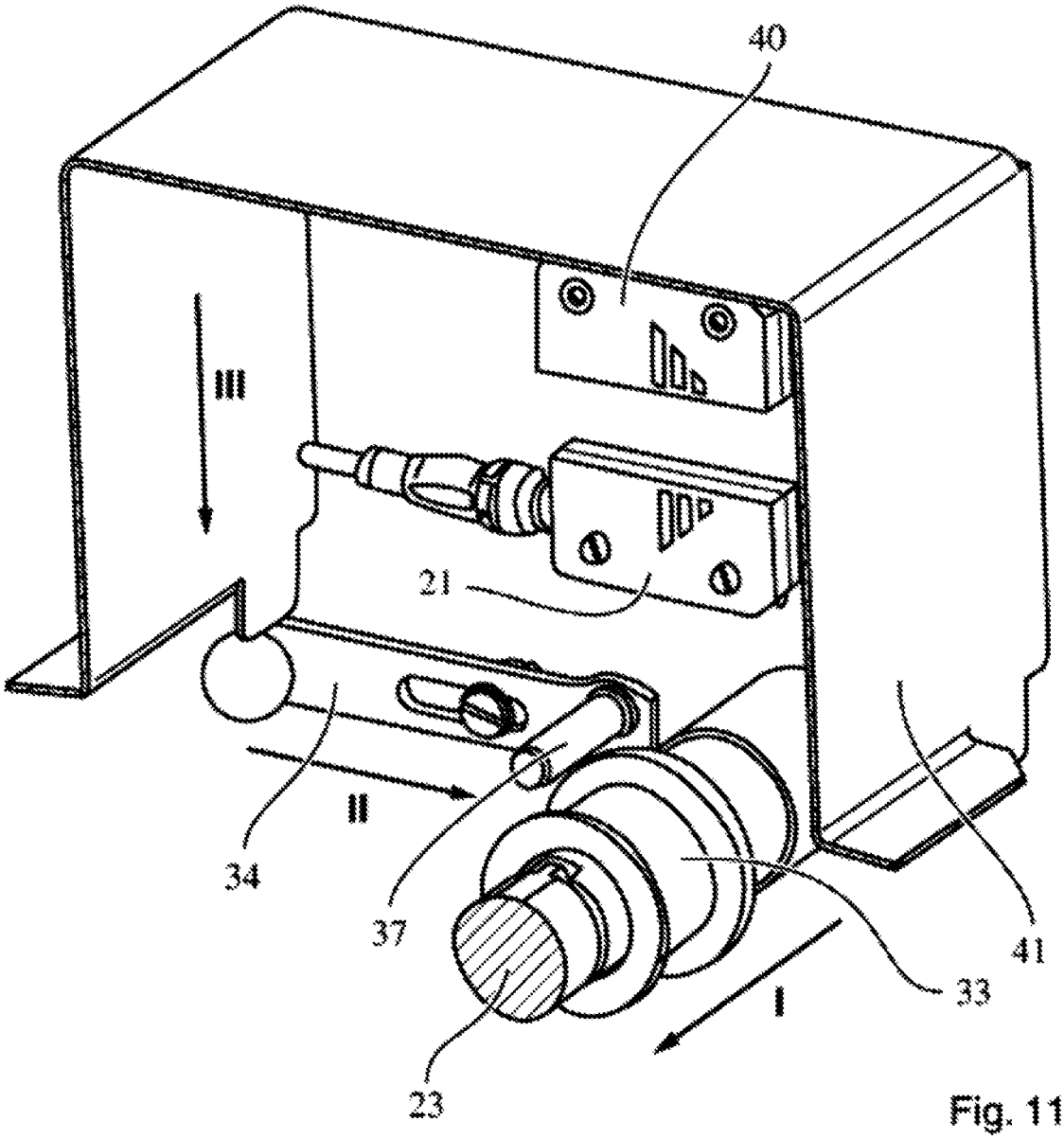
FIG. 11 shows the electronic locking of the protective cover.

As already mentioned in the introduction, the longitudinal cutter cassette according to the invention is preferably provided such that a protective cover 41, which protects the longitudinal cutter cassette during operation, can be installed only when the locking mechanisms of the longitudinal cutter cassette are located in a quite specific position. This is illustrated in FIG. 11. As is illustrated by the arrow I, once the connection between the driveshaft 32 and the blade shaft 23 has been established, the bushing 33 is pushed over the connection between the two shafts. Only then is space provided for the locking pin 37, and therefore the locking bar 34, as is illustrated by the arrow II, can be displaced in this case from right to left. It is only this displacement movement which frees up the space required to place the protective cover 41 in position, as is illustrated by the arrow III, in the downward direction from above onto the packaging machine or the base of the longitudinal cutter cassette. The connection between two electronic components 21, 40, for example 2 RFIDs, also takes place here. This connection enables the packaging machine, to the extent where the latter can be started up.

Yet another locking mechanism for the packaging machine according to the invention is illustrated in the upper part of FIG. 3. It is only when the bushing 33 is pushed over the connection between the driveshaft 32 and the blade shaft 23, as is illustrated by the arrow I, that the protective cover can be installed, as is illustrated by the arrow II, and the two components 21, 40 can be brought into contact with one another. It is only when this contact, which rather than having to be physical may also be achieved for example by electromagnetic waves, has been established that the packaging machine can be brought into operation.

Figure 12A:
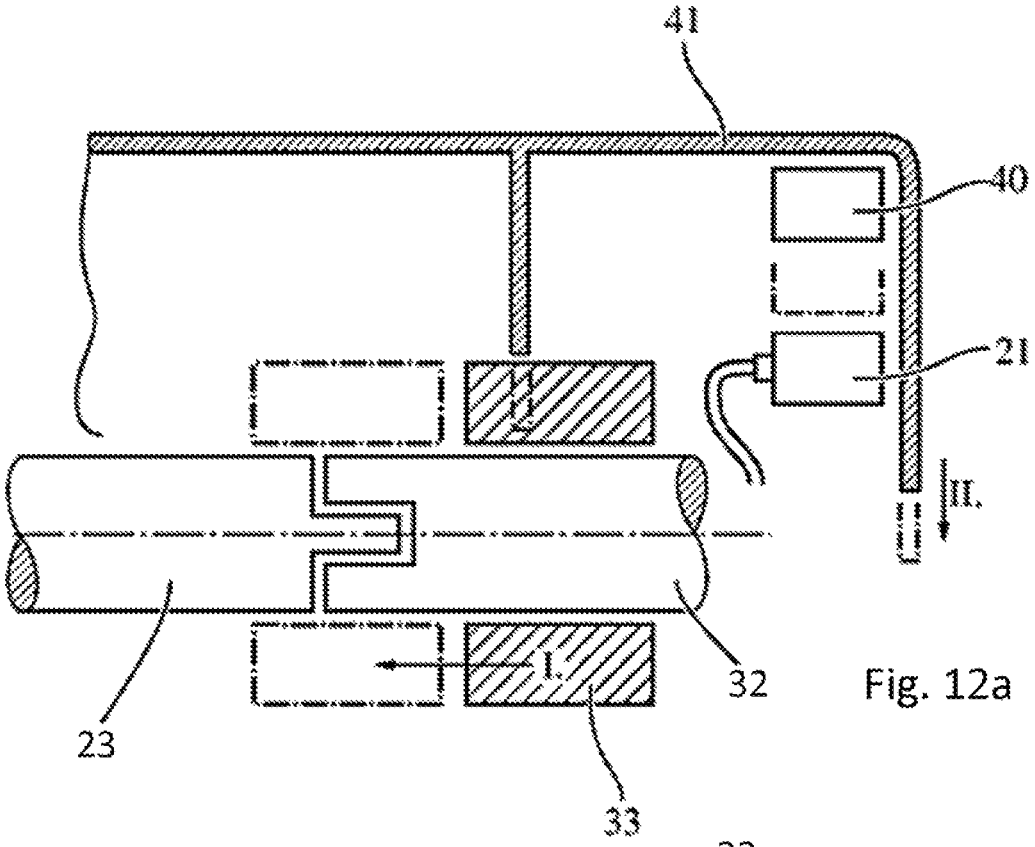
FIGS. 12*a*, 12*b* shows the electronic locking of the protective cover.
Figure 12B:
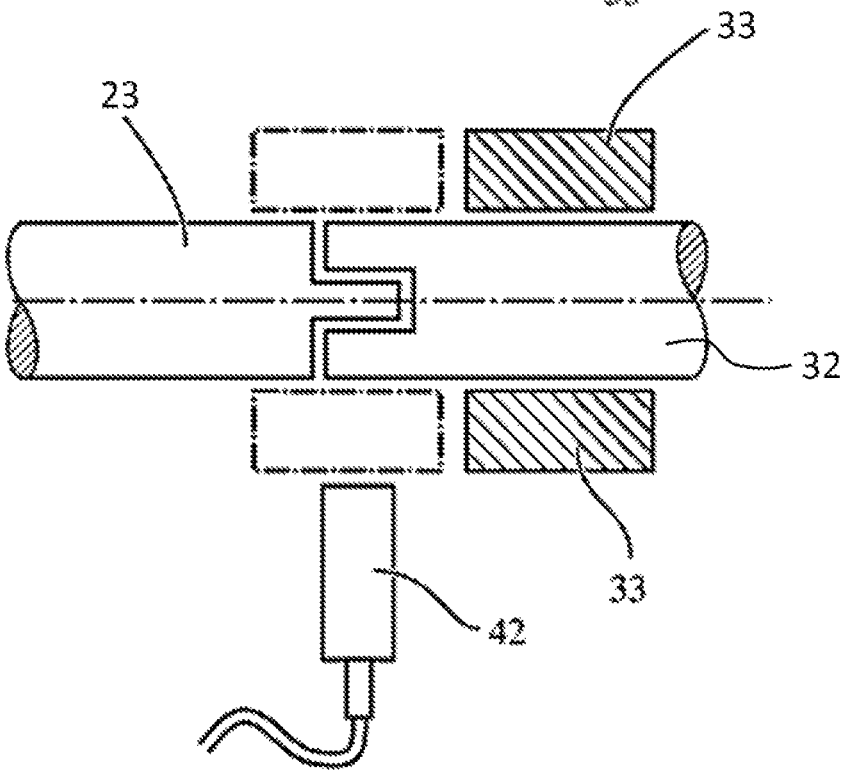

One more embodiment is illustrated in FIGS. 12*a* and 12*b*. In the present case, the packaging machine and/or the longitudinal cutter cassette have/has a sensor 42, which detects the position of the bushing 33 and allows the packaging machine to start up only when it is located in the region of the connection between the two shafts 23, 32.

LIST OF REFERENCE SIGNS

1 Packaging machine
2 Forming station, thermoforming station
3 Upper tool of the thermoforming station
4 Lower tool of the thermoforming station
5 Lifting table, carrier of a tool of the sealing station, thermoforming station and/or of the cutting device
6 Pack cavity
7 First filling station
8 Sheet web, lower-sheet web
9 Lifting device
10 Longitudinal cutting cassette
11 Lower tool of the sealing station
12 Upper tool of the sealing station
13 Handle, carrying handle
14 Upper-sheet web, cover sheet
15 Sealing station
16 Article
17 Longitudinal cutter
18 Transverse cutter
19 Entry region
20 Centering means
21 Identifier, RFID
22 Longitudinal cutting blade
23 Blade shaft
24 Lifting/lowering mechanism
25 Protective enclosure
26 Safety catch
27 Point of rotation of the handle
28 Slot
29 Aperture, slot
30 Baseplate
31 Side part
32 Driveshaft
33 Bushing
34 Locking bar
35 Protrusion
36 Flattened portion
37 Locking pin
38 Form fit, force fit, groove/tongue
39 Rotation-blocking means
40 Identifier, RFID for the protective cover
41 Protective cover
42 Sensor
43 Means for securing the blade shaft against rotation in the raised position

The invention claimed is:

1. A cutter cassette comprising:
a blade shaft,
at least one cutting blade arranged on the blade shaft, and
a housing, wherein the blade shaft is configured to be lowered relative to the housing to move the blade shaft in a reversible manner from a transporting position to an operating position, and wherein the lowering of the blade shaft takes place under gravitational force, wherein the cutter cassette comprises a lifting and lowering mechanism for moving the blade shaft between the transporting position and the operating position; and wherein in the transporting position, the blade shaft rests on the lifting and lowering mechanism.

2. The cutter cassette as claimed in claim 1, wherein the cutter cassette comprises a protective enclosure.

3. The cutter cassette as claimed in claim 2, wherein the cutter cassette comprises a blocking mechanism that is configured to prevent a protective cover from being placed in a position on the cutter cassette when the blade shaft is not connected to a drive.

4. The cutter cassette as claimed in claim 2, wherein the protective enclosure has a U-shaped or a V-shaped configuration.

5. The cutter cassette as claimed in claim 1, wherein the cutter cassette comprises a safety mechanism and a protective cover, wherein the safety mechanism is configured to prevent the protective cover from being placed in a position on the cutter cassette when the blade shaft is not connected to a drive.

6. The cutter cassette as claimed in claim 5, wherein the safety mechanism comprises a bushing, a locking bar, and a locking pin.

7. The cutter cassette as claimed in claim 1, wherein the cutter cassette comprises a carrying handle.

8. The cutter cassette as claimed in claim 7, wherein the carrying handle is configured to drive the lifting and lowering mechanism.

9. The cutter cassette as claimed in claim 1, wherein the housing is rigid.

10. The cutter cassette as claimed in claim 1, wherein in the transporting position, the blade shaft is configured to be secured against rotation and/or against being lowered and/or being raised up.

11. The cutter cassette as claimed in claim 1, wherein the cutter cassette comprises a carrying handle for transporting the cutter cassette, and wherein movement of the handle moves the cutter cassette between the transporting position and the operating position.

12. The cutter cassette as claimed in claim 1, wherein the lifting and lowering mechanism comprises vertical guides that secure the blade shaft from rotating when the blade shaft is in the transporting position.

13. The cutter cassette as claimed in claim 1, wherein the cutter cassette comprises a baseplate, and wherein in the transporting position, the at least one cutting blade is free from projecting out of the baseplate.

14. A packaging machine for producing a pack, comprising:

the cutter cassette as claimed in claim 1, a sealing station that is configured to seal an upper sheet web onto a pack cavity or seal together two sheet ends, wherein the pack cavity is thermoformed into a lower sheet web, or the upper sheet web and the lower sheet web are subjected to a forming process, wherein the packaging machine comprises at least one circulating chain, which transports the upper sheet web and the lower sheet web.

15. The packaging machine as claimed in claim 14, wherein the packing machine comprises a centering means, which interact with a centering means of the cutter cassette.

16. The packaging machine as claimed in claim 15, wherein the centering means of the cutter cassette fixes the cutter cassette in at least two directions, the centering means of the cutter cassette comprises a front centering means, wherein the front centering means are circle-segment-form recesses.

17. The packaging machine as claimed in claim 15, wherein the packaging machine comprises a manual drive, by means of which the blade shaft can be rotated into an installation position and/or a removal position.

18. The packaging machine as claimed in claim 14, wherein the packaging machine comprises a manual drive, by means of which the blade shaft is rotated into an installation position and/or a removal position.

19. A cutter cassette comprising:

a blade shaft, on which at least one cutting blade is arranged, a protective enclosure that has a U-shaped or a V-shaped configuration, a blocking mechanism comprising a bushing, a locking bar, and a locking pin, the blocking mechanism prevents a protective cover from being placed in position on the cutter cassette when the blade shaft is not connected properly to a drive, a carrying handle for transporting the cutter cassette, wherein movement of the handle moves the cutter cassette between a transporting position and an operating position, wherein the cutter cassette comprises a lifting and lowering mechanism, and in the transporting position, the blade shaft rests on the lifting and lowering mechanism, wherein lowering of the blade shaft takes place under gravitational force, and wherein the lifting and lowering mechanism comprises vertical guides that secure the blade shaft from rotating when the blade shaft is in the transporting position.

* * * * *